United States Patent [19]

Jones et al.

[11] Patent Number: 4,520,958

[45] Date of Patent: Jun. 4, 1985

[54] MULTI-COMPARTMENT ENVELOPE FOR COUPON NESTING

[75] Inventors: John H. Jones, Westfield; Donald W. Schoenleber, Princeton, both of N.J.

[73] Assignee: Beatrice Foods Co., Chicago, Ill.

[21] Appl. No.: 507,139

[22] Filed: Jun. 23, 1983

[51] Int. Cl.[3] ..... B65D 27/08

[52] U.S. Cl. ..... 229/72; 229/76; 283/51

[58] Field of Search ..... 229/68 R, 70, 72, 84, 229/87, 80, 76, 71, 92.3, 92.7, 73, 77, 92.8, 92.1; 150/32, 39; 40/10 R; 206/63.3; 283/51, 52

[56] References Cited

U.S. PATENT DOCUMENTS

| | | | |
|---|---|---|---|
| 729,429 | 5/1903 | Shattue | 150/39 |
| 1,267,175 | 5/1918 | Boyington | 229/80 |
| 1,683,996 | 9/1928 | Snow | 150/39 |
| 2,298,601 | 10/1942 | Tremblett | 229/92.7 |
| 2,718,911 | 9/1955 | Solomon | 229/72 |
| 3,522,908 | 8/1970 | Carrigan | 229/71 |
| 3,759,305 | 9/1973 | McIntyre | 150/39 |
| 4,044,942 | 8/1977 | Sherwood | 229/73 |
| 4,237,947 | 12/1980 | Mater | 150/39 |
| 4,312,393 | 1/1982 | Green | 150/39 |
| 4,428,526 | 1/1984 | Riley | 229/92.8 |
| 4,429,787 | 2/1984 | Morse | 229/72 X |

*Primary Examiner*—Allan N. Shoap
*Assistant Examiner*—Bryon Gehman
*Attorney, Agent, or Firm*—Shlesinger Arkwright Garvey & Fado

[57] ABSTRACT

A multi-compartment envelope for coupon nesting includes a rectangular blank having first, second and third spaced parallel scorelines defining first, second, third and fourth rectangular interconnected panels. A fold in the fourth panel provides a first panel portion and a second panel portion with the second panel portion being secured to the first panel portion and thereby providing a compartment. A slit is disposed in the compartment and divides the compartment into a first and a second compartment. A first and a second contoured slit are disposed, at least in part, in the first panel and provide a pair of wafer tabs. The first panel is in overlying relation with the second panel whereby the wafer tabs extend a substantial distance in a first direction away from the first panel. The fourth panel is folded along the third scoreline and overlies same while the third panel is then folded along the second scoreline whereby the fourth panel overlies the first panel and the third scoreline is proximate the first scoreline. The wafer tabs are folded so that a surface thereof engages the third panel and glue secures the first surface of the wafer tabs to the third panel.

20 Claims, 4 Drawing Figures

MULTI-COMPARTMENT ENVELOPE FOR COUPON NESTING

BACKGROUND OF THE INVENTION

The use of premium coupons for stimulating a recipient's interest and enthusiasm for the relevant goods or services has increased greatly in the recent past. Distribution of a plurality of various coupons has proven to be the most cost effective means of providing the recipient with the coupons. The premium coupons involved are normally comprised of a generally rectangularly-shaped planar member on which advertising and other information is printed. Because of the fact that the coupons are relatively thin, being manufactured from a sheet of paper, there has arisen the problem of economically packaging a number of coupons so that they may be distributed to the recipient by the mail, by magazine inserts, by newspaper inserts, as well as by other distribution methods.

Premium coupons must be low cost in their manufacture and distribution in order for them to be cost effective to the provider of the goods or services. Not only must the distribution mechanism be cost effective, but it must also be capable of supplying all of the coupons, Additionally, it is preferred that a means be provided for orienting the coupons prior to their distribution so that they may be arranged in a manner felt to be most responsive to the interests of the ultimate recipient.

In view of the above, a new and unique means for efficiently distributing premium coupons in a cost effective way is necessary. The present invention provides such a cost effective distribution means by providing a planar member having peripheral edges, at least a flat compartment secured to a first one of said edges and extending therefrom and adapted for storing therein a plurality of generally planar inserts, the at least a first compartment being folded generally along said first one of said edges and overlying at least a portion of said planar member, and means for maintaining the at least a first compartment in said overlying relationship with said planar member.

OBJECTS AND SUMMARY OF THE INVENTION

A primary object of the disclosed invention is to provide a single or multi-compartment insert for the nesting of coupons which is both cost effective in terms of distribution and capable of being manufactured with minimal cost.

An additional object of the disclosed invention is to provide a multi-compartment envelope insert which is capable of being manufactured from a single sheet of paper and which requires minimal amount of glue.

Yet another object of the disclosed invention is to provide a multi-compartment envelope insert which is adapted for storing and retaining therein a plurality of planar inserts or coupons.

Yet an additional object of the disclosed invention is to provide two compartments for said insert and in which both of said compartments are adapted for storing and retaining therein a plurality of inserts.

Still yet a further object of the disclosed invention is to provide a multi-compartment envelope insert which is capable of being folded so that the inserts are contained within the interior of the envelope and in which the envelope is sealed.

Yet still a further object of the disclosed invention is to provide a multi-compartment envelope insert which is sealed by wafer seals and yet which is easy to open.

Yet still another object of the disclosed invention is to provide a multi-compartment envelope insert in which means are provided for readily accessing the nested inserts.

Still yet an additional object of the disclosed invention is to provide a multi-compartment envelope insert which is adapted to have contained on the surfaces thereof printed matter such as advertising or the address of the recipient.

Yet still an additional object of the disclosed invention is to provide a multi-compartment envelope insert which is adapted for being transmitted through the mails, with magazines and with newspapers.

These and other objects and advantages of the invention are readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
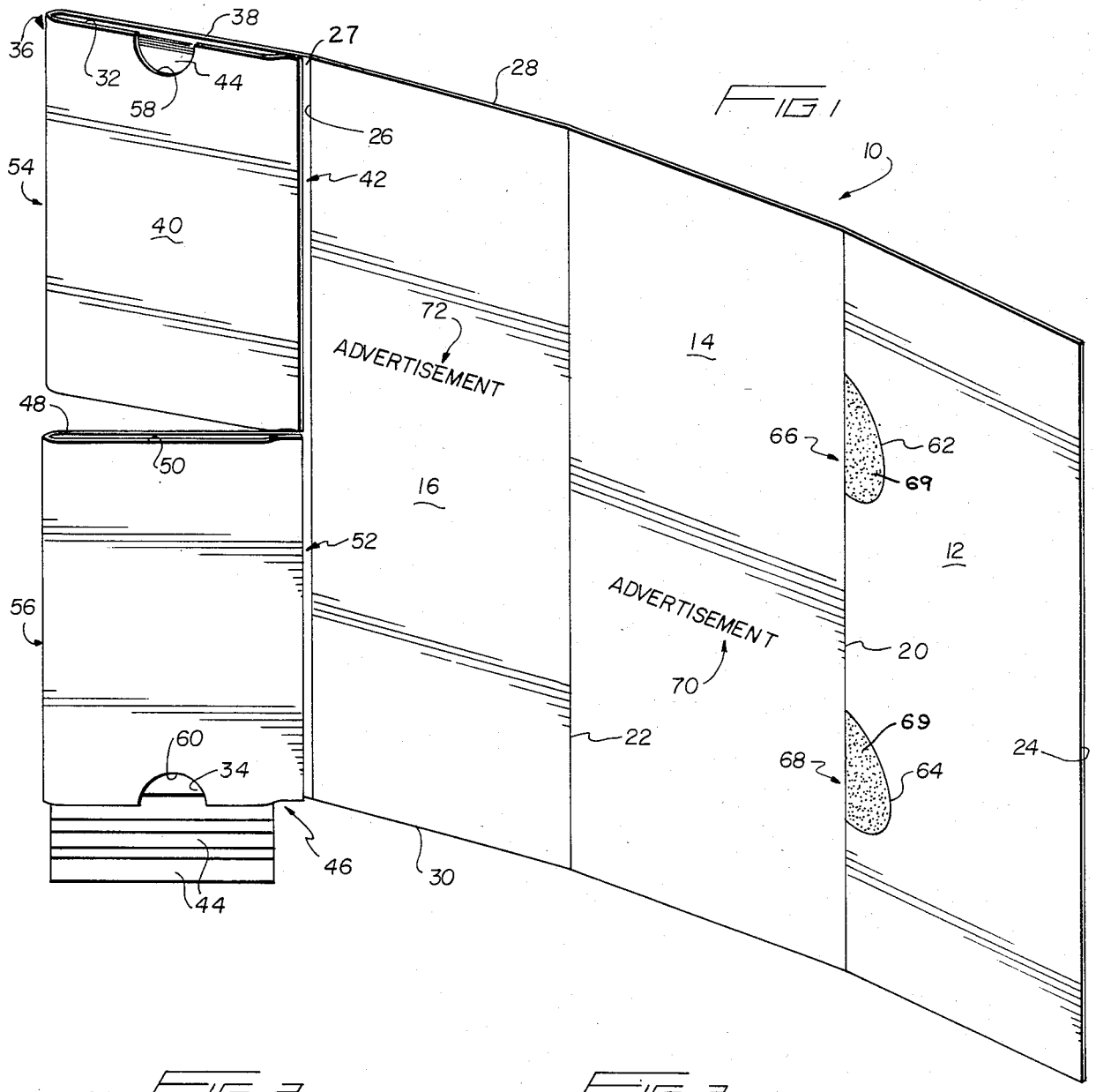
FIG. 1 is a perspective view of the multi-compartment envelope insert for coupon nesting of the invention.

A multi-compartment envelope insert 10 for coupon nesting, as best shown in FIG. 1, is manufactured from a generally rectangular paper blank. While the blank is disclosed as being made of paper, it should be clearly obvious that other suitable types of materials, such as plastics, films, cardboards, as well as others, may be used without detracting from the present invention.

Envelope 10 includes first panel 12, second panel 14, and third panel 16. A first score line 20 defines the boundary between first panel 12 and second panel 14 and a second score line 22 defines the boundary between second panel 14 and third panel 16. Score lines 20 and 22 are generally parallel to side edges 24 and 26 and are generally transverse of upper edge 28 and lower edge 30.

A first generally rectangular compartment 32 is secured to edge 26. A second generally rectangular compartment 34 is likewise secured to edge 26 and spaced from compartment 32.

Figure 2:
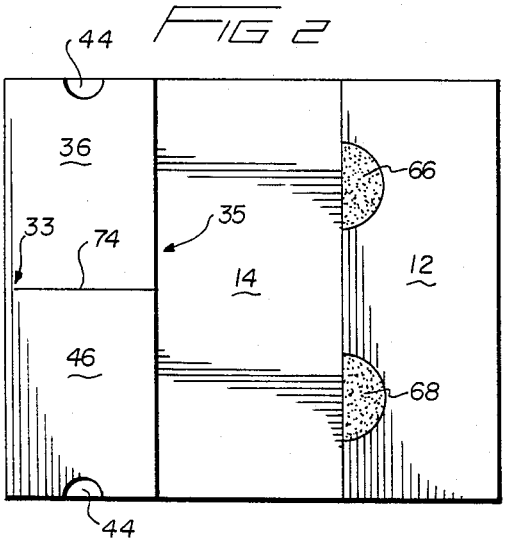
FIG. 2 is a top plan view of the envelope of FIG. 1 in the partially folded condition.

Compartments 32 and 34 are, preferably, integral with envelope 10 and extend from edge 26 and are interconnected at 33, as best shown in FIG. 2. Compartment 32 includes a flap extension 36 which extends from edge 26 of third panel 16. Flap extension 36 has a portion 38 and a portion 40, which is in an overlying relationship with portion 38, and which is secured to portion 38, generally in the area of edge 42, and generally parallel to edge 26, by glue or other suitable sealing means well known in the art. Because of the overlying relationship of portion 40 relative to portion 38, first compartment 32 is formed therebetween and is uniquely adapted for holding and retaining therein a plurality of generally planar inserts or premium coupons 44. A sufficient number of inserts 44 are stored in first compartment 32 so that the inserts 44 exert a pressure on portions 38 and 40 sufficient to cause the inserts 44 to be retained in compartment 32. In this way, there is no need for glue, flaps, or other sealing means for retaining the inserts 44 in compartment 32.

Second compartment 34 is shown similar to first compartment 32 and includes flap extension 46. It may be longer or shorter as desired. Flap extension 46 is integral with envelope 10 and extends outwardly from edge 26. Flap extension 46 includes portions 48 and 50. Portion 50 is maintained in an overlying relationship relative to portion 48 by glue or other suitable sealing means which secures edge 52 generally parallel to edge 26. Second compartment 34 is formed because of the overlying relationship of 48 and 50, respectively, and is, likewise, adapted for receiving and retaining therein a plurality of generally planar inserts for premium coupons 44, as previously described.

It should be obvious, that flap extension 36 and flap extension 46 are preferably comprised of a single sheet of paper 35, as best shown in FIG. 2, which is unitary with envelope 10. Sheet 35 extends outwardly from edge 26 and is folded back upon itself in an overlying relationship and has an edge secured parallel to edge 26. A slit generally transverse of score lines 20 and 22 separates first compartment 32 from second compartment 34. In this way, the manufacturing of envelope insert 10 and compartments 32 and 34 may be greatly simplified.

It should be obvious that the outwardly extending edge 54 of compartment 32 and the outwardly extending edge 56 of compartment 34 may have their distances from edge 26 varied by increasing the overall length of flap extensions 36 and 46 so as to alter the position of edges 54 and 56.

Preferably, compartments 32 and 34 include generally semi-circular cutouts 58 and 60, respectively, which are adapted to permit the recipient to readily access inserts 44 and to overcome the internally generated pressure which retains inserts 44 in the compartments 32 and 34.

First panel 12 includes cutouts 62 and 64 which extend from score line 20 and which are generally circular shaped and which define wafer seals 66 and 68. Wafers 66 and 68 have glue 69, or other suitable sealing means, on one surface thereof. While wafers 66 and 68 are disclosed as being generally circular shaped, it should be obvious that they could have any number of shapes.

Panels 14 and 16 are disclosed as having advertisements 70 and 72 on one surface thereof for arousing the interest of the recipient of the envelope insert.

Figure 3:
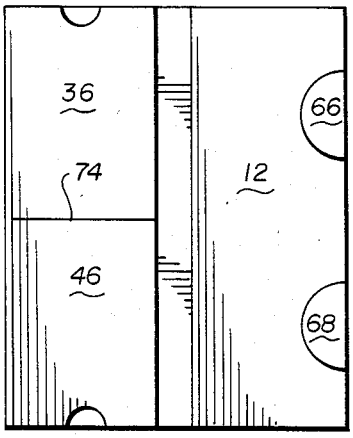
FIG. 3 is yet another top plan view of the envelope insert of FIGS. 1 and 2 in a further stage of being folded; and, FIG. 4 is a top plan view of the envelope insert of FIGS. 1–3 in the final sealed condition.
Figure 4:
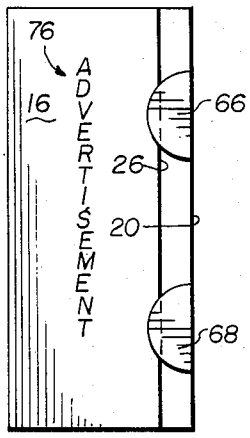

The process of folding and sealing the envelope 10 is best shown in FIGS. 2–4. As best shown in FIG. 2, a flap extensions 36 and 46 have been folded along edge 26 which preferably includes a score line, and compartments 32 and 34 have been filled with a sufficient number of inserts 44. It should be noted in FIG. 2 that a slit 74 in sheet 35 separates first compartment 32 from second compartment 34. Slit 74 does not span the width of the unitary panel of sheet 35 of which flap extensions 36 and 46 are comprised.

As best shown in FIG. 3, first panel 12 has been folded along score line 20. Finally, in FIG. 4, third panel 16, including compartments 32 and 34 which are in an overlying relationship with third flap 16, is folded along score line 22 and edge 26 is positioned some distance from score line 20 so that wafers 66 and 68 may seal third panel 16 in its overlying relationship with first panel 12. Glue 69 of wafers 66 and 68 acts to secure third panel 16, including its overlying compartments 32 and 34. It should be noted in FIG. 1 that the first and third panels 12 and 16 have a width somewhat less than second panel 14 and a width somewhat greater than that of said flap extensions 36 and 46 so that a predetermined distance separates edge 26 or its coincident score line 27 from score line 20 to facilitate ease of opening of envelope 10 by the recipient. The recipient may insert his fingers in the gap defined by score lines 27 and 20 and may, therefore, readily open envelope 10 so to access inserts 44. It should be noted in FIG. 4 that third panel 16 also contains advertisement 76 on the surface opposed from the surface on which advertisement 72 is printed.

While this invention has been described as having a preferred design, it is understood that it is capable of further modifications, uses and/or adaptations of the invention following the general principle of the invention and including such departures from the present disclosure as commonly known or customary practice in the art to which the invention pertains, and as it may be applied to the central features hereinbefore set forth, and fall within the scope of the invention of the limits of the appended claims.

What we claim is:

1. A multi-compartment envelope for coupon nesting, comprising:

(a) a generally rectangular blank having first, second and third spaced parallel scorelines defining first, second, third and fourth generally rectangular interconnected panels;

(b) said first panel and said fourth panel each having a side edge;

(c) a fold in said fourth panel generally equidistant said fourth panel side edge and said third scoreline and generally parallel thereto providing a first panel portion and a second panel portion;

(d) means securing said fourth panel side edge to said first panel portion generally adjacent said third scoreline whereby said second panel portion overlies said first panel portion and thereby said panel portions provide a compartment;

(e) a slit being disposed in said first and second panel portions and extending from said fold to generally adjacent said third scoreline and thereby dividing said compartment into a first compartment and a second compartment;

(f) a first and second contoured slit, each of said contoured slits being disposed at least in part in said first panel and each of said contoured slits defining a wafer tab;

(g) said first panel being folded on said first scoreline and thereby overlying said second panel whereby said wafer tabs extend a substantial distance in a first direction away from said first panel;

(h) said fourth panel being folded along said third scoreline and thereby overlying said third panel;

(i) said third panel being folded along said second scoreline whereby said fourth panel overlies said first panel and said third scoreline is proximate said first scoreline;

(j) said wafer tabs being folded on a line generally parallel to said first scoreline whereby said wafer tabs extend in a second direction generally aligned with said first panel and a first surface of each of said wafer tabs engages a substantial portion of said third panel; and, (k) seal means securing said first surface of each of said wafer tabs to said third panel.

2. The envelope as defined in claim 1, wherein:

(a) at least one of said contoured slits extending from said first scoreline.

3. The envelope as defined in claim 1, wherein:

(a) said contoured slits being generally semicircular-shaped.

4. The envelope as defined in claim 1, wherein:

(a) said wafer tabs being folded along a line coincident with said first scoreline.

5. The envelope as defined in claim 1, wherein:

(a) said seal means including glue.

6. The envelope as defined in claim 1, wherein:

(a) said slit being generally transverse to said third scoreline.

7. The envelope as defined in claim 6, wherein:

(a) said blank having an upper and a lower edge; and, (b) said slit being generally equidistant said upper and lower edges.

8. The envelope as defined in claim 1, wherein:

(a) each of said first and second compartments including means for accessing the interior of said compartments.

9. The envelope as defined in claim 8, wherein:

(a) said blank having an upper and a lower edge;

(b) said first compartment being associated with said upper edge and said second compartment being associated with said lower edge;

(c) a cut-out portion being disposed in one of said first and second panel portions of said first compartment and extending from said upper edge for providing said means for accessing; and, (d) a cut-out portion being disposed in one of said first and second panel portions of said second compartment and extending from said lower edge for providing said means for accessing.

10. The envelope as defined in claim 9, wherein:

(a) each of said cut-out portions being generally semicircular-shaped.

11. The envelope as defined in claim 1, wherein:

(a) said second panel having a width exceeding the width of said first and third panels and of said compartments whereby said third scoreline is spaced from said first scoreline when said fourth panel overlies said first panel.

12. The envelope as defined in claim 1, wherein:

(a) a plurality of planar inserts being positioned in each of said compartments.

13. A multi-compartment envelope for coupon nesting, comprising:

(a) a generally rectangular blank having first, second and third spaced parallel scorelines defining first, second, third and fourth generally rectangular interconnected panels;

(b) each of said first and fourth panels having a side edge;

(c) a fold in said fourth panel generally equidistant said fourth panel side edge and said third scoreline and generally parallel thereto providing a first panel portion and a second panel portion;

(d) means securing said fourth panel side edge to said first panel portion generally adjacent said third scoreline whereby said second panel portion overlies said first panel portion and thereby said panel portions provide a compartment;

(e) a slit being disposed in said first and second panel portions generally transverse to said scorelines and extending from said fold to generally adjacent said third scoreline and thereby dividing said compartment into a first and a second compartment;

(f) a first and a second generally semicircular slit, each of said semicircular slits being disposed at least in part in said first panel and each of said semicircular slits defining a wafer tab;

(g) said first panel being folded on said first scoreline and thereby overlying said second panel whereby said wafer tabs extend a substantial distance in a first direction away from said first panel;

(h) said fourth panel being folded along said third scoreline and thereby overlying said third panel;

(i) said third panel being folded along said second scoreline whereby said fourth panel overlies said first panel and said third scoreline is proximate said first scoreline;

(j) said wafer tabs being folded on a line generally parallel to said first scoreline whereby said wafer tabs extend in a second direction generally aligned with said first panel and a first surface of each of said wafer tabs engages a substantial portion of said third panel; and, (k) glue means securing said first surface of each of said wafer tabs to said third panel.

14. The envelope as defined in claim 13, wherein:

(a) said wafer tabs being folded on a line coincident with said first scoreline.

15. The envelope as defined in claim 13, wherein:

(a) said second panel having a width exceeding the width of said first and third panels and of said compartments whereby said third scoreline is spaced a substantial distance from said first scoreline when said fourth panel overlies said first panel.

16. The envelope as defined in claim 13, wherein:

(a) said blank having an upper and a lower edge; and, (b) said slit being generally equidistant said upper and lower edges.

17. The envelope as defined in claim 16, wherein:

(a) said first compartment being associated with said upper edge and said second compartment being associated with said lower edge; and, (b) a generally semicircular cut-out being disposed in one of said first and second panel portions of said first compartment and extending from said upper edge as a means for accessing the interior of said first compartment.

18. The envelope as defined in claim 13, wherein:

(a) a plurality of generally planar inserts being positioned in each of said compartments.

19. The envelope as defined in claim 13, wherein:

(a) an advertisement being imprinted on at least one of said panels.

20. The envelope as defined in claim 13, wherein:

(a) said semicircular slits extending from said first scoreline.

* * * * *